US005456636A

United States Patent [19]

Suzuki

[11] Patent Number: 5,456,636

[45] Date of Patent: Oct. 10, 1995

[54] MAGICAL TRICK DEVICE FOR CARD SLASHING

[75] Inventor: Tooru Suzuki, Tokyo, Japan

[73] Assignee: Tenyo Co., Ltd., Tokyo, Japan

[21] Appl. No.: 252,514

[22] Filed: Jun. 1, 1994

[30] Foreign Application Priority Data

Jun. 2, 1993 [JP] Japan ..... 5-029422 U

[51] Int. Cl.[6] ..... A63J 21/00

[52] U.S. Cl. ..... 472/73; 273/148 R; 446/219

[58] Field of Search ..... 472/57, 73, 51, 472/54, 71, 72; 273/148 R, 149 R, 148 A; 446/219; 40/124.1, 427, 445

[56] References Cited

U.S. PATENT DOCUMENTS 4,013,286 3/1977 Nagai ..... 472/73
4,068,841 1/1978 Kuna et al. ..... 472/72 X

*Primary Examiner*—Carl D. Friedman
*Assistant Examiner*—Kien T. Nguyen
*Attorney, Agent, or Firm*—Sixbey, Friedman, Leedom & Ferguson; Gerald J. Ferguson

[57] ABSTRACT

A case assembly is pivotably attached to a stand or frame by means of a hinge mechanism. Vertical slits are formed in a front member and a rear member of the case assembly, respectively. A leaf spring is provided as interposed between the front member and rear member. A dummy cutter is fitted in the case assembly slidably along the slits. A card is inserted into the case assembly from a transversal slit formed in the top of the front member. The cutter is inserted into the vertical slit in the rear member of the case assembly. The case is pivoted against the resilience of the leaf spring to project the dummy cutter out of the vertical slit in the front member. When the cutter and therefore the dummy cutter are moved vertically together, the card inserted in the case assembly will appear as if it were broken through and slashed by the cutter. Thus, using the magical trick device according to the present invention, everybody can enjoy a card slashing trick simply by inserting a card into the case assembly and inserting the cutter into the vertical slit in the rear member of the case assembly, moving it vertically or extracting it.

6 Claims, 12 Drawing Sheets

MAGICAL TRICK DEVICE FOR CARD SLASHING

BACKGROUND OF THE INVENTION a) Field of the Invention

The present invention relates to a magical trick device for playing a trick that a bank card or credit card, for example, is slashed using a cutter and it is restored to its initial state, and more particularly, to a magical trick device for card slashing, which can be an easy amusement to everybody everywhere.

b) Related Art Statement

Various magical trick devices have so far been proposed. One of them is known from the disclosure in the Japanese Examined Utility Model Publication No. 61-6960, in which a part of a housing containing a stick-like thing such as a cigarette is slid horizontally in a direction to provide an illusion that the cigarette is cut off while it is slid in the opposite direction to restore the cigarette to its initial state.

SUMMARY OF THE INVENTION

The present invention has an object to provide a novel magical trick device for giving an illusion that a card is slashed by a cutter and is restored to its initial state and which is easily enjoyable by anybody anywhere.

The above object is accomplished by providing a magical trick device comprising, according to the present invention, a cutter for use to play a trick of card slashing; a frame having a front and rear openings; a front member fixed to the frame to cover the front opening of the frame and provided with a transversal slit formed in the top thereof and through which a card can be inserted and also a first vertical slit formed in the front thereof; a case assembly pivotably attached to the front member by means of a hinge mechanism, having a card receiving space communicating with the transversal slit in the front member and provided with a second vertical slit corresponding to the first vertical slit and in which the cutter can be inserted; a resilient member interposed between the front member and case assembly to always force the case assembly away from the front member; and a dummy cutter slidable along the second vertical slit in relation to the case assembly.

The dummy cutter consists of a sliding portion slidable along the second vertical slit inside the case assembly, an elongated C-shaped portion extending from the sliding portion to outside the case assembly, and a tip portion extending nearly perpendicularly to the first or second vertical slit, having a substantially same shape as the cutter and which is projected out from the first vertical slit in the front member when the case assembly is pressed and pivoted toward the front member against the resilience of the resilient member.

For using this magical trick device according to the present invention, a card is first inserted from the transversal slit formed in the top of the front member into the case assembly. The card will be received between the sliding portion of the dummy cutter and the cover member of the case assembly.

Next, the cutter is inserted from outside into the second vertical slit formed in the case assembly in such a manner that it is engaged in the sliding portion of the dummy cutter. When the cutter is forced or pressed toward the front member, the case assembly will pivoted against the resilience of the resilient member. Thus, the tip portion of the dummy cutter will be projected cut from the first vertical slit. When the cutter is vertically moved along the second vertical slit in the case assembly, the tip portion of the dummy cutter projecting out of the first vertical slit is also moved vertically. The cutter inserted into the device from behind the case assembly will appear as if it broke through the card in the case assembly and projected out of the front member, and also the card in the case assembly will appear as if it were slashed by the cutter, as the latter is moved vertically.

Since the cutter inserted into the case assembly is engaged in the sliding portion of the dummy cutter while the tip portion of the dummy cutter, extending from the sliding portion inside the case assembly to outside the case assembly is projected out of the first vertical slit, so the card appears as if it were broken through and slashed by the cutter. Actually, however, the card is received between the sliding portion disposed inside the case assembly and the cover member of the case assembly, so it is neither broken through nor slashed by the cutter.

When the cutter is taken out of the second slit in the case assembly, the latter is returned under the action of the resilient member. Therefore, when the card in the case assembly is extracted from the transversal slit in the front member, the card having seemed as if it had been broken through and slashed by the cutter will appear as if it had been restored to its initial state.

Therefore, everybody can enjoy a magical trick of card slashing with this device everywhere simply by inserting a card into the case assembly, inserting the cutter into the second vertical slit in the case assembly, moving it along the slit, extracting it from the slit thereafter and taking the card out of the case assembly.

Note that the cutter used with this device may be a fake sword. In this case, use of a dummy fake sword of which the tip portion has a generally same shape as that of the fake sword will add a further reality to such a play of card break-through and slashing.

Furthermore, it should be noted that a window may be formed in the front member by the side of the first vertical slit and an operable door be provided which has a size large enough to close the window while another window be formed in the cover member of the case assembly in a position corresponding to the window in the front member. These additional features will make the card slashing trick much more realistic because the card can be effectively proved to be really received in the case assembly by opening the door when the tip portion of the dummy fake sword is projected out of the first vertical slit in the front member.

Furthermore, a membrane made of an elastic material such as rubber in which a cut is formed along the first vertical slit may be provided on the rear side of the front member and over the firs vertical slit therein. Thus, it is possible to prevent the inside of the case assembly from being visible from outside through the first vertical slit in the front member, whereby the secret of the trick can be prevented from being revealed and so a further enjoyment be ensured.

These and other objects and advantages of the present invention will be better understood from the ensuing description made by way of example of the embodiment of the magical trick device for card slashing according to the present invention with reference to the accompanying drawings.

DETAILED DESCRIPTION OF THE PREFERRED EMBODIMENT

Figure 1:
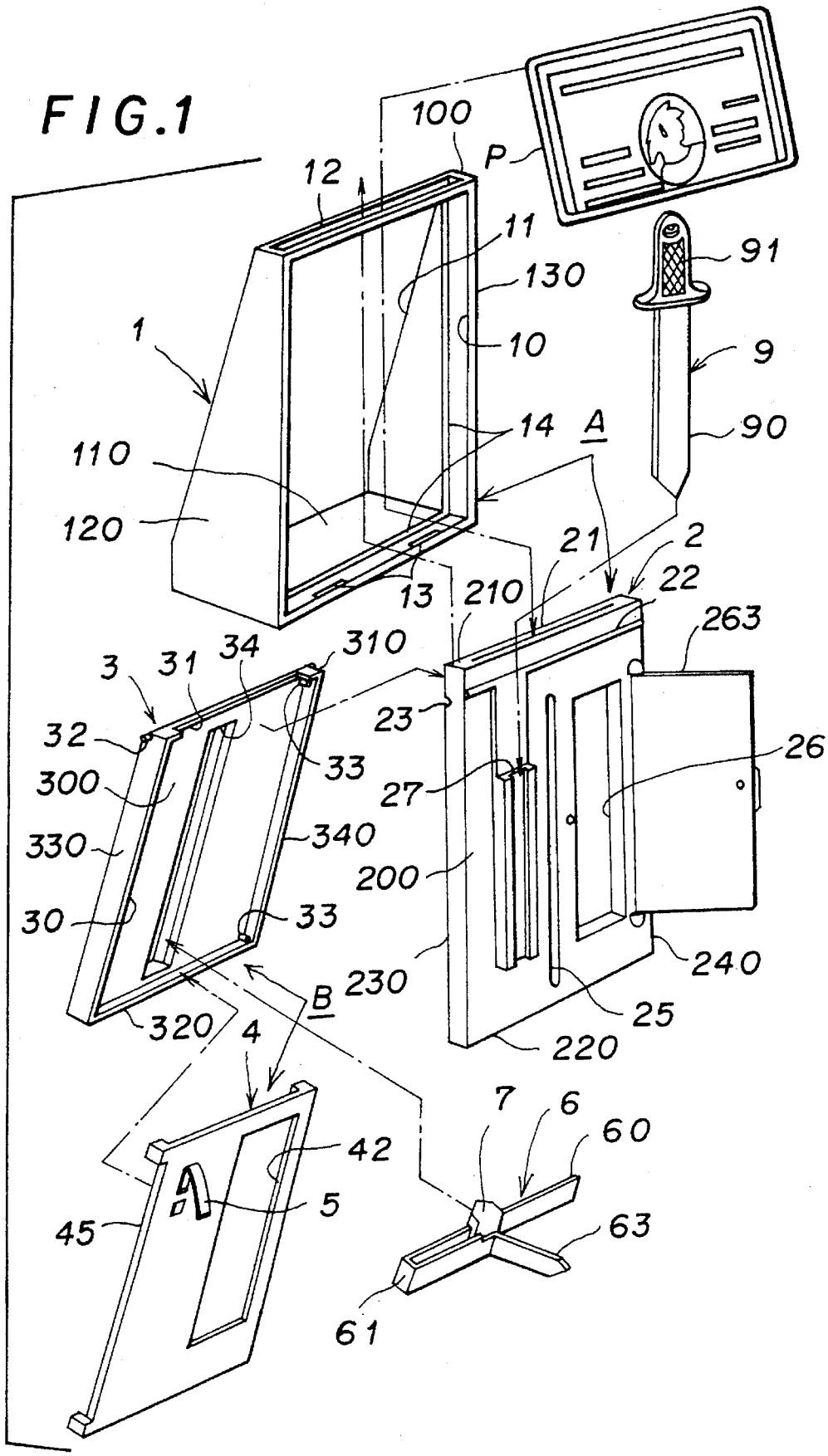
FIG. 1 is an exploded perspective view of an embodiment of the magical trick device according to the present invention.
Figure 2:
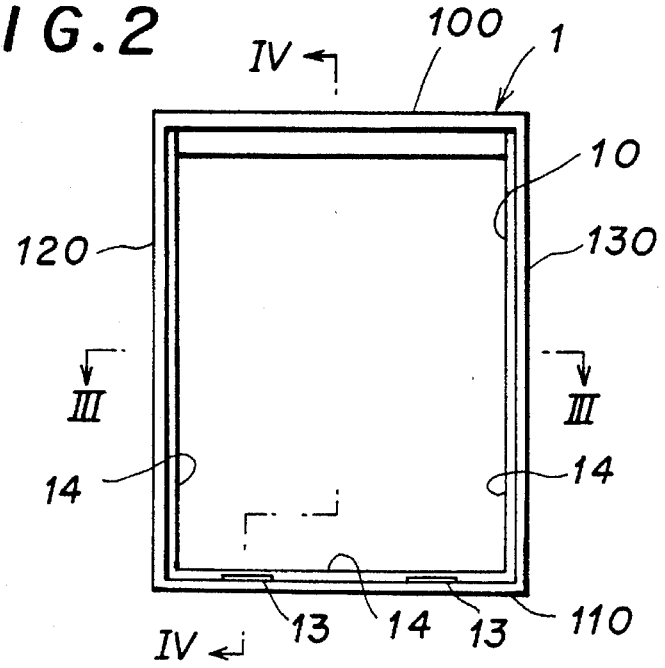
FIG. 2 is a front view of the frame.

Referring now to FIG. 1, a card used in the magical trick with the device according to the present invention is indicated generally with P. It is a bank card, credit card, (trump) card or the like. The reference numeral 9 indicates a cutter for use to play a magical trick of cutting of the card P. In this embodiment, it is a fake sword having a metallic blade portion 90 and a hilt portion 91 made made of a synthetic resin integrally with the blade portion 91.

Figure 3:
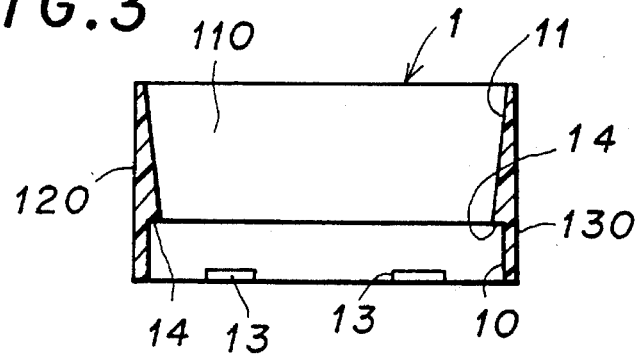
FIG. 3 is a sectional view taken along the line III—III in FIG. 2.
Figure 4:
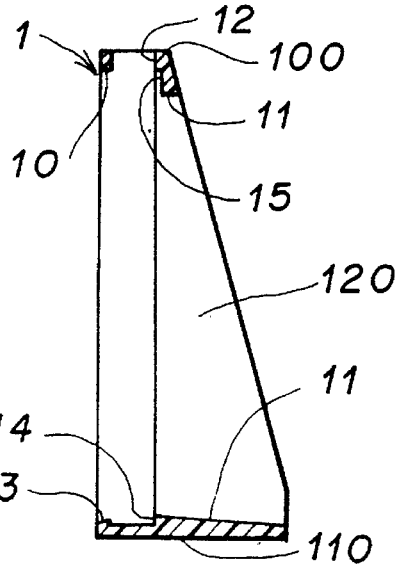
FIG. 4 is a sectional view taken along the line IV—IV in FIG. 2.

The reference symbol A generally indicates a stand of the magical trick device according to the present invention. The reference numeral 1 indicates a frame forming a part of the stand A. The frame 1 consists of a top plate 100, bottom plate 110, left side plate 120 and a right side plate 130. The frame 1 has a front opening 10 and a rear opening 11. The left and right side plates 120 and 130 are formed in a generally trapezoidal shape, respectively. The frame 1 has an elongated rectangular opening 12 formed in the top plate 100 thereof and two engagement pawls 13 formed adjacently to the lower edge of the front opening 10 in the bottom plate 110. The left and right side plates 120 and 130 and the bottom plate 110 have formed on the inner walls, respectively, thereof steps 14 flush with the rear edge of the opening 12 and which serve to position to the frame 1 the front member 2 which forms the stand A together with the frame 1 as will be described later. Further, there is formed another step 15 under the rear edge of the opening 12. The inner walls of the left and right side plates 120 and 130 and bottom plate 110 are tapered from the steps 14 toward the rear opening 11 as shown in FIGS. 3 and 4.

Figure 6:
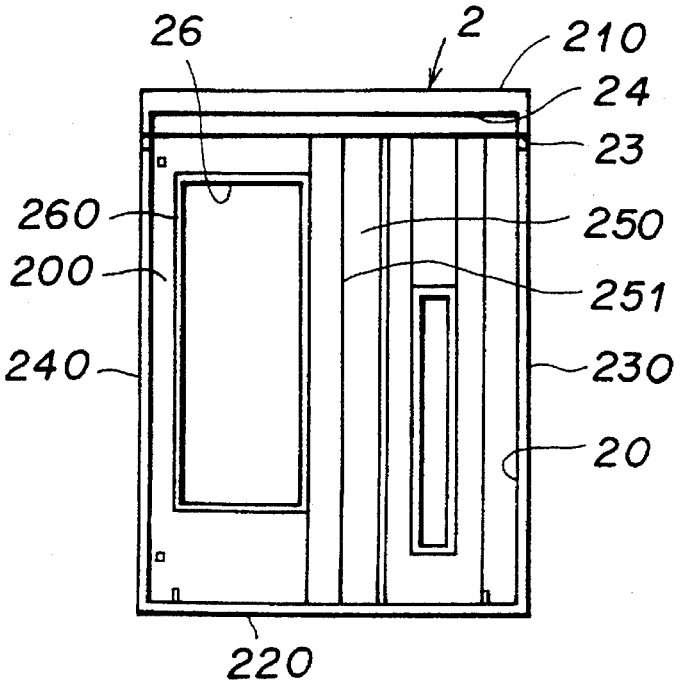
FIG. 6 is a rear view of the front member.
Figure 7:
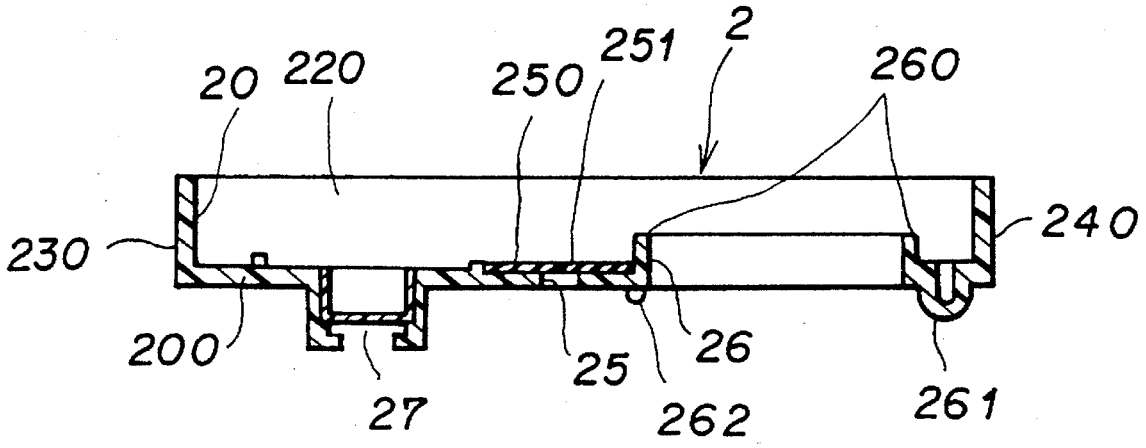
FIG. 7 is a sectional view taken along the line VII—VII in FIG. 5.
Figure 8:
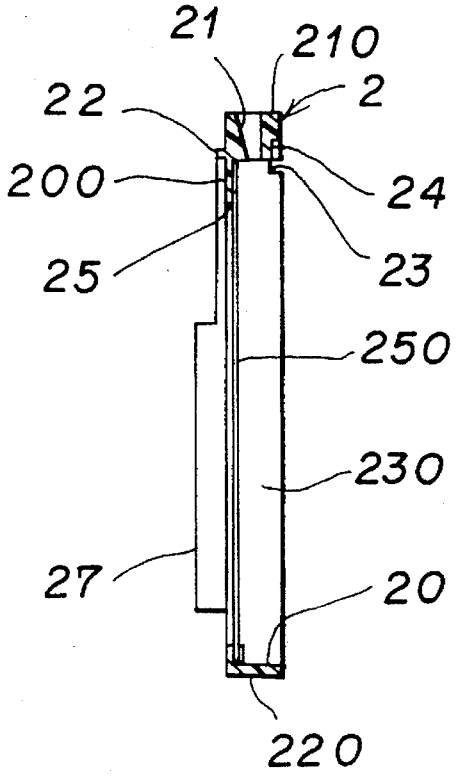
FIG. 8 is a sectional view taken along the line VIII—VIII in FIG. 5.

The front member 2 is fitted to the frame 1 to form the stand A. The front member 2 is a shallow case defined by a front plate 200, top plate 210, bottom plate 220, left side plate 230 and right side plate 240. Thus the front member 2 has a rear opening 20. The top plate 210 has formed therein a slit 21 through which the card P is to be inserted, and the front plate 200 has an engagement projection 22 formed integrally therewith at the upper portion thereof. The left and right side plates 230 and 240 have semicircular bearing holes 23, respectively, formed herein adjacently to the rear opening 20 as shown in FIG. 1. The top plate 210 has a step 24 formed at the upper edge of the rear opening 20 as shown in FIG. 6.

Figure 5:
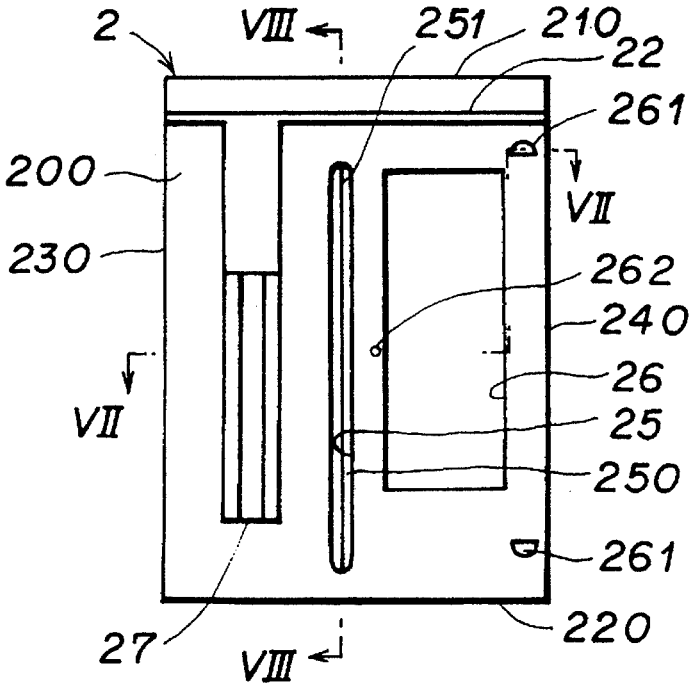
FIG. 5 is a front view of the front member.

The front plate 200 has a vertical slit 25 formed nearly in the center thereof. A membrane 250 made of an elastic material such as rubber is provided on the rear side of the front plate 200 as extended along and over the vertical slit 25. The elastic membrane 250 has a cut 251 formed along the vertical slit 25. The front plate 200 has a rectangular window 26 formed adjacently to the vertical slit 25 therein and which is edged with a rising wall 260 all around the window 26 as shown in FIG. 6. The rising wall 26 is formed integrally on the rear side of the front plate 200 as directed rearward. As shown in FIG. 5, the front plate 200 has bearings 261 formed integrally therewith at the upper and lower portions, respectively, thereof adjacently to the right edge of the window 26 and an engagement projection 262 formed integrally therewith at the middle of the left edge of the window 26.

The front plate 200 of the front member 2 has formed thereon adjacently to the vertical slit 25 a holder 27 to receive the cutter 9.

For assembling the device, the top portion of the front member 2 of such a construction is fitted into the opening 12 in the top of the frame 1 while the engagement projection 22 is engaged onto the upper edge of the front opening 10. In this state, the front member 2 is force-fitted into the front opening 10 of the frame 1, the edge of the rear opening 20 of the front member 2 is forcibly fitted to the steps 14 of the frame 1, and the lower edge of the front plate 20 is engaged onto the engagement pawls 13 of the frame 1. Thus, the front member 2 is fixed into the front opening 10 of the frame 1.

Figure 9:
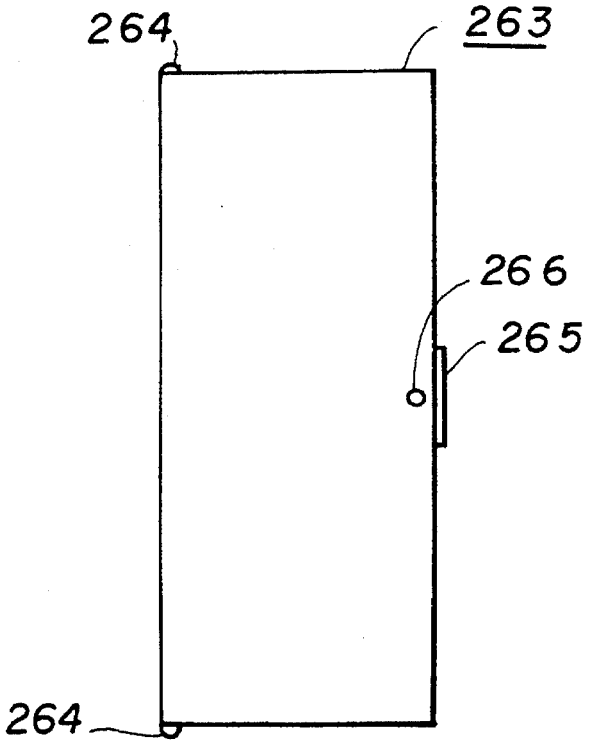
FIG. 9 is a rear view of the door.
Figure 10:
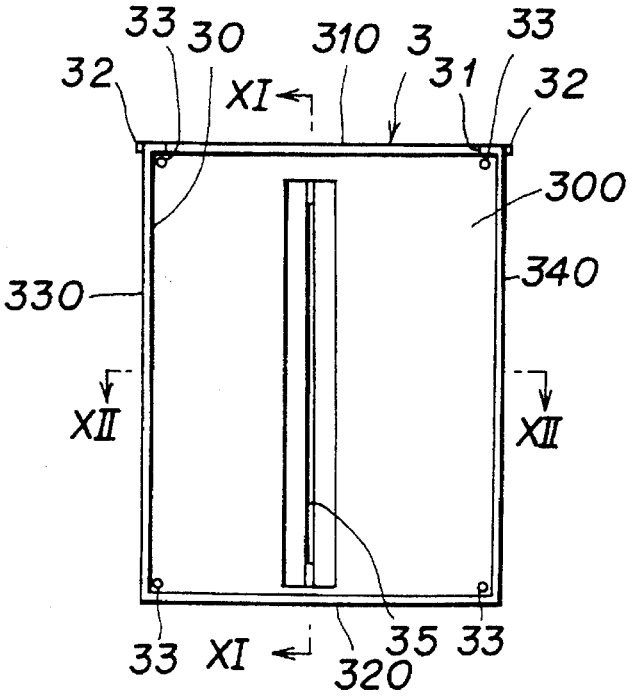
FIG. 10 is a front view of the rear member of the case assembly.
Figure 11:
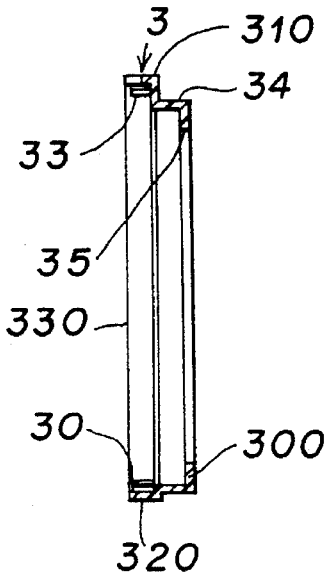
FIG. 11 is a sectional view taken along the line XI—XI in FIG. 10.
Figure 12:
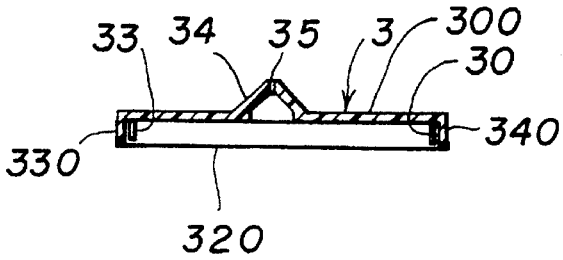
FIG. 12 is a sectional view taken along the line XII—XII in FIG. 10.
Figure 13:
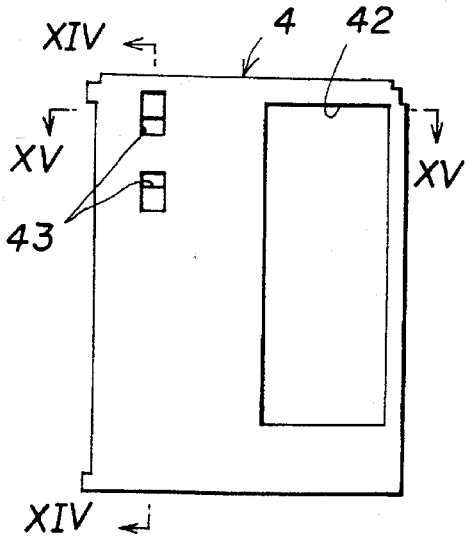
FIG. 13 is a front view of the cover member which forms the case assembly along with the rear member.
Figure 14:
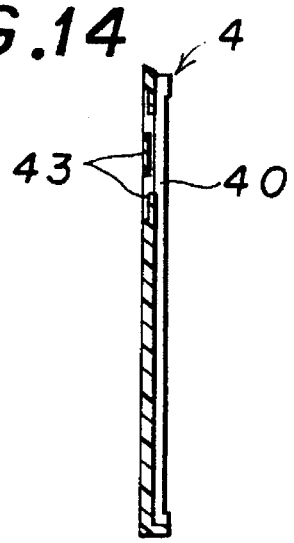
FIG. 14 is a sectional view taken along the line XIV—XIV in FIG. 13.

In FIGS. 1 and 9, the reference numeral 263 indicates a door. The door 263 is made of an opaque synthetic resin, for example. It is formed in the shape of a rectangular plate having a size large enough to cover the window 26 in the front member 2. The door 263 has small cylindrical pivots 264 formed integrally on, and as projected from, the upper end lower end faces, at one side, thereof. The door 263 has a handle 265 formed integrally at the middle height on the other side thereof. The door 263 has an engagement hole 266 formed on the rear side thereof correspondingly to the engagement projection 262.

The pivots 264 of the door 263 are pivotably fitted in the bearings 261 on the front member 2, The door 263 is closed with the engagement hole 266 in the door 263 set to receive the engagement projection 262 of the front member 2 to cover the window 26 in the front member 2.

In FIGS. 1, 10 through 12, the reference numeral 3 indicates a rear member forming a part of a case assembly B. The rear member 3 is also a shallow case consisting of a rear plate 300, top plate 310, bottom plate 320, left side plate 330 and right side plate 340, all made of a synthetic resin. Thus, the rear member 3 has a front opening 30. The front opening 30 of the rear member 3 has such a size that it can be received in the rear opening 20 of the front member 2. The rear member 3 has a cut 31 formed nearly in the center of the top plate 310 thereof. The left and right side plates 330 and 340 have pivots 32 formed integrally on, and as projected from, the outer tops, respectively, thereof. The rear plate 300 has a small cylindrical engagement projection 33 formed integrally at, and as projected from, each of the four corners thereof.

The rear plate 300 of the rear member 3 has formed integrally therewith nearly at the center thereof a hollow projection 34 of which the sectional shape is generally triangular. The projection 34 is convex in the rearward direction. It has a vertical slit 35 formed on the ridge thereof correspondingly to the vertical slit 25 in the front member 2. The rear member 3 is pivotably attached to the front member 2 by means of a hinge mechanism. More particularly, the hinge mechanism is formed from the combinations of the pivots 32 in pair on the rear member 3 with the bearing holes 23, respectively, in the front member 2.

Figure 15:
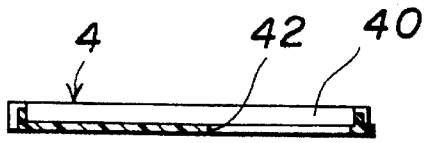
FIG. 15 is a sectional view taken along the line XV—XV in FIG. 13.
Figure 16:
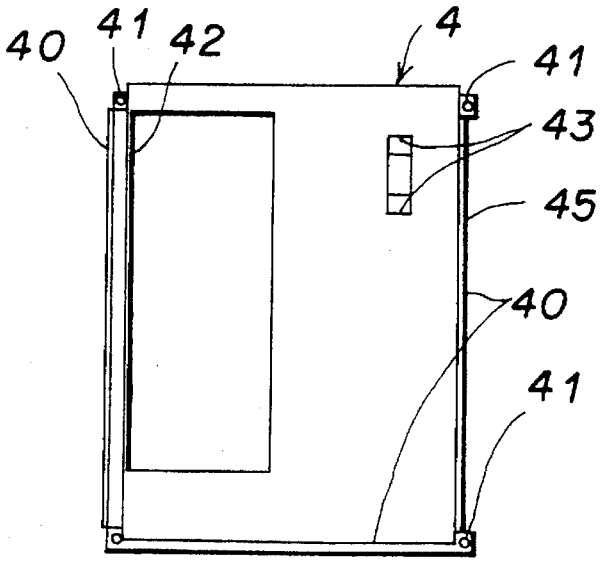
FIG. 16 is a rear view of the cover member.
Figure 17:
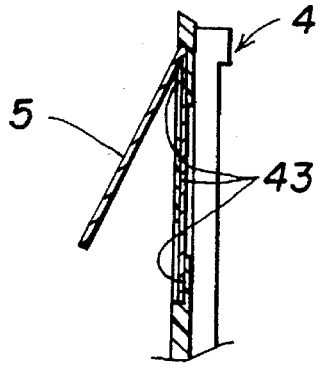
FIG. 17 is a fragmentary sectional view showing the leaf spring fixed to the cover member.

The rear member 3 has the front opening 30 thereof closed by a cover member 4 which also forms a part of the case assembly B along with the rear member 3. The cover member 4 is made of an opaque synthetic resin, for example, and formed in the shape of a rectangular plate of which the size is such that it can be received in the front opening 30 of the rear member 3. As shown in FIGS. 15 and 16, the cover member 4 has projections 40 formed integrally on, and as projected rearward from, the rear side at both the right and left side edges and at the lower edge thereof. Also the cover member 4 has small-circular engagement holes 41 formed at four corners of the rear side thereof correspondingly to the engagement projections 33 on the rear member 3. The cover member 4 has a rectangular window 42 formed correspondingly to the window 26 in the front member 2. Also, the cover member 4 has formed in the left upper portion thereof two small square holes 43 in which a leaf spring 5 is fixed. The leaf spring 5 is formed in the shape of an elongated rectangle. It is made of a thin metal sheet bent in a generally V shape. The leaf spring 5 is fixed as inserted at one end thereof, by threading, through both the square holes 43 and abuts at the other end thereof to the rear side of the front plate 200 of the front member 2. Furthermore, the cover member 4 has a cut 45 formed as centered in the left edge thereof.

For assembling the device, the engagement projections 33 of the rear member 3 are fitted in the engagement holes 41 in the cover member 4, the end face of the projection 40 of the cover member 4 is applied to the front side of the rear plate 300 of the rear member 3 and then the cover member 4 is fixed to cover the front opening 30 in the rear member 3. In this state, there is defined between the rear side of the cover member 4 and the rear member 3 a space 44 communicating with the opening 21 in the top of the front member and through which the card P is to be inserted or taken out. As mentioned above, the rear member 3 and cover member 4 form together the case assembly B and more particularly the cover member 4 forms the front of the case assembly B.

The aforementioned leaf spring 5 is provided as interposed between the front member 2 and cover member 4 to always force the case assembly B consisting of the rear member 3 and cover member 4 away from the stand A consisting of the frame 1 and front member 2. That is to say, the case assembly B is always forced away from the front member 2 of the stand A.

Figure 18:
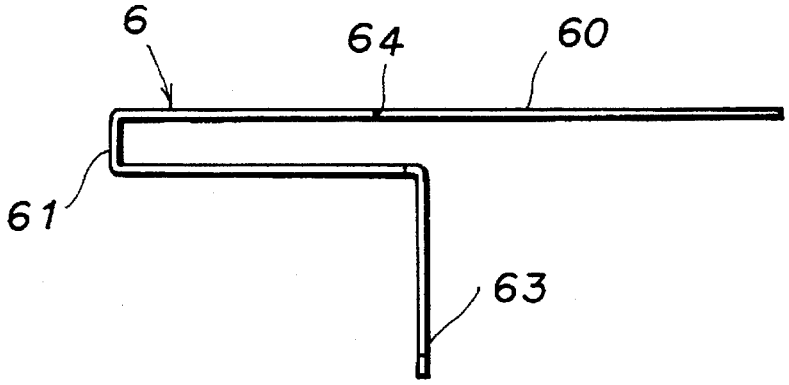
FIG. 18 is a plan view of the dummy cutter.
Figure 19:
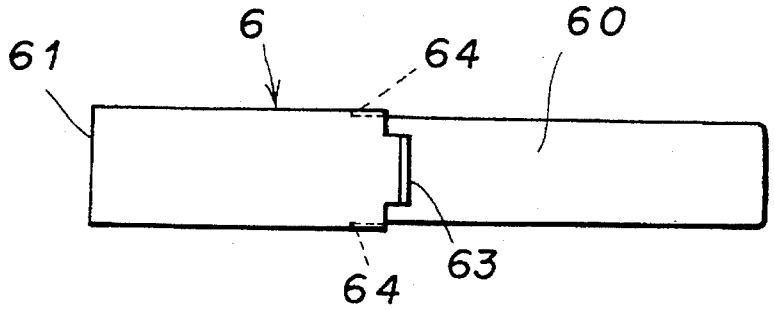
FIG. 19 is a front view of the dummy cutter.

As shown in FIGS. 1, 18 and 19, the reference numeral 6 indicates a dummy cutter made of an elongated, thin metal plate, for example. The dummy cutter 6 consists of a sliding portion 60 nearly equal in width to the space 44 for reception of the card P, an elongated generally C-shaped portion 61 made by bending the marginal length of the sliding portion 60 into such a shape and of which the arms thus made extend in parallel to the sliding portion 60, and a tip portion 63 made by bending the marginal length of the portion 61 at a right angle and designed identical to the blade portion 90 of the cutter 9. The sliding portion 60 has engagement steps 64 formed at the top and bottom, respectively, nearly at the center thereof.

The sliding portion 60 of the dummy cutter 6 is disposed at the front of the rear plate 300 of the rear member 3 while the C-shaped portion 61 is disposed at the front of the cover member 4 as extended around the cut 45 formed at the left side end portion of the cover member 4. That is, the card P received in the space 44 is positioned between the sliding portion 60 and cover member 4.

The tip portion 63 of the dummy cutter 6 is disposed opposite to the vertical slit 25 in the front member 2. It is to be projected out of the vertical slit 25 in the front member 2 when the case assembly B consisting of the rear member 3 and cover member 4 is pressed or pivoted toward the front member 2 against the resilience of the leaf spring 5.

Figure 20:
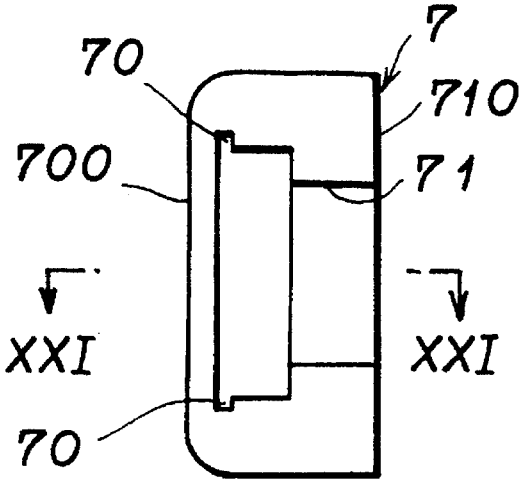
FIG. 20 is a side elevation of the cutter receptacle.
Figure 21:
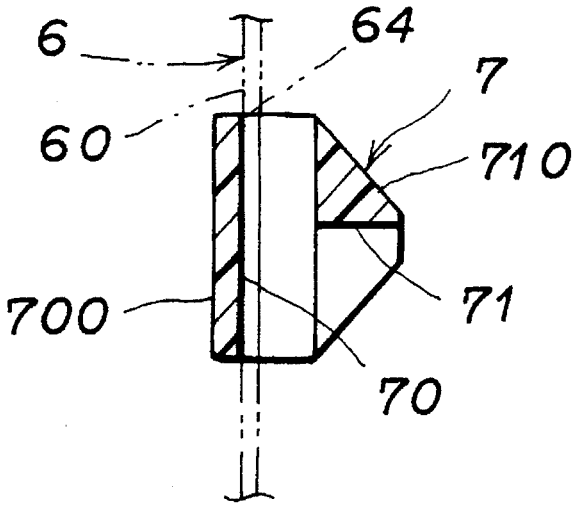
FIG. 21 is a sectional view taken along the line XXI—XXI in FIG. 20.

As shown in FIGS. 1, 20 and 21, the reference numeral 7 indicates a receptacle for the cutter 9, made of a synthetic resin, for example. The receptacle 7 consists of a front portion 700 which is to be engaged in the dummy cutter 6, and a rear portion 710 which is to be received in the projection 34 of the rear member 3. The front portion 700 has formed therein recesses 70 for reception of the sliding portion 60, while the rear portion 710 has formed therein a cut 71 for reception of the cutter 9.

For assembling, the sliding portion 60 of the dummy cutter 6 is inserted into the receiving recesses 70 of the receptacle 7 to the engagement steps 64 to fix the receptacle 7 to the dummy cutter 6. In this state, the rear portion 710 of the receptacle 7 is slidably received in the hollow projection 3 of the rear member 3.

Figure 22:
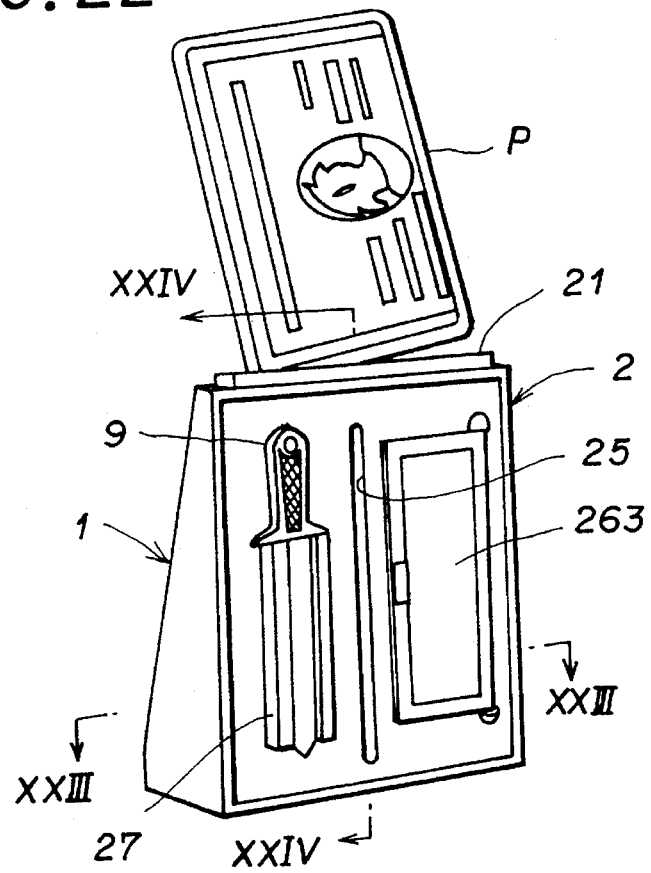
FIG. 22 is a perspective view showing the card received in the case assembly.

The magical trick device is constructed as having been described in the foregoing, and is to be operated as will be explained below:

First, the door 263 is closed and the cutter 9 is placed in the holder 27 formed on the front member 2 of the stand S, as shown in FIG. 22. Next, the card P is inserted from the opening 21 in the top of the front member 2 into the case assembly C consisting of the rear member 2 and cover member 4. In this state, the card P is received between the sliding portion 60 of the dummy cutter 6 disposed in the case assembly B and the front of the cover member 4.

Next, the cutter 9 is taken from the holder 27, the blade portion 90 of the cutter 9 is inserted from outside into the slit 35 in the rear member 3 and engaged in the cut 71 in the receptacle 7 integral with the sliding portion 60 of the dummy cutter 6. Then, the cutter 9 is pressed to pivot the case assembly B consisting of the rear member 3 and cover member 4 toward the front member 2 against the resilience of the leaf spring 5 to project the tip portion 63 of the dummy cutter 6 from the slit 25 in the front member 2 through the cut 251 in the rubber membrane 250. Further, the cutter 9 is moved along the slit 35 in the rear member 3 to move the tip portion 63 projected out of the vertical slit 25 in the rear member 3, along the vertical slit 25.

At this time, the cutter 9 inserted into the case assembly B from behind the rear member 3 appears to the audience as if it had broken through the card P in the case assembly B and projected out of the front member 2 and further slashed the card P in the case assembly B as the cutter 9 is moved vertically.

In this state, the cutter 9 inserted into the case assembly B from the vertical slit 35 in the rear member 3 is engaged in the receptacle 7 integral with the sliding portion 60 of the dummy cutter 6 while the tip portion 63 of the dummy cutter 6 is projected out of the vertical slit 25 in the front member 2. So, the cutter 9 appears as if it had broken through the card P and slashed it. Actually, however, since the card P is positioned in the space between the cover member 4 and sliding portion 60, so the card P has never been broken through and slashed.

Thereafter, the cutter 9 is pulled out of the vertical slit 35 in the rear member 3. The case assembly B consisting of the rear member 3 and cover member 4 is returned to its initial position under the action of the leaf spring 5. When the card P is taken out of the case assembly B, the audience will be given an illusion that the card P once broken through and slashed with the cutter 9 has been reproduced and restored to its initial state.

Hence, the magical trick device according to the present invention can be an easy amusement for everybody everywhere simply by inserting or taking out the card P into or from the case assembly B, inserting the cutter 9 into the vertical slit 35 in the rear member 3, moving the cutter 9 along the vertical slit 35 and extracting it from the vertical slit 35.

Especially in this embodiment, a fake sword is used as the cutter 9 and the tip portion 63 of the dummy cutter 9 is formed similar to the blade portion of the fake sword 9, so that the audience will feel a further reality with such a magical break-through and slashing of the card P.

Figure 25:
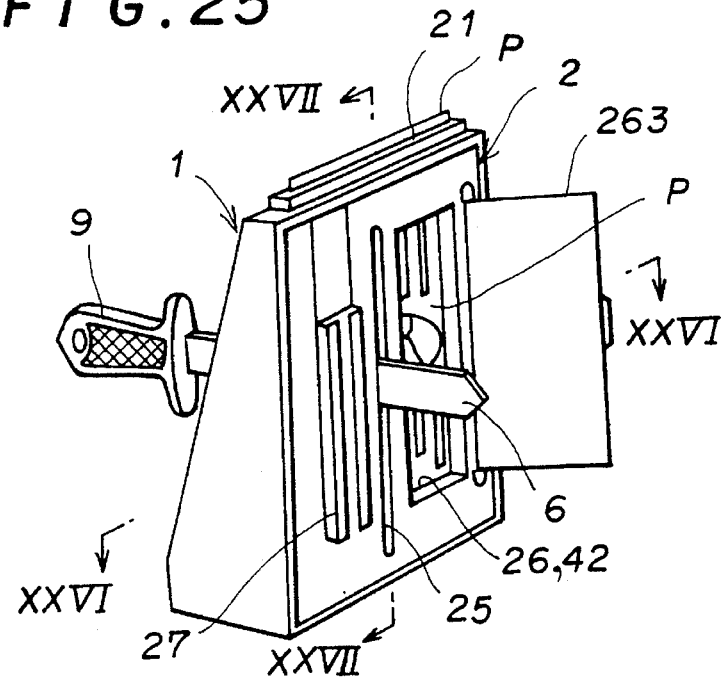
FIG. 25 is a perspective view showing the dummy cutter projected out of the front member while the door is opened.
Figure 23:
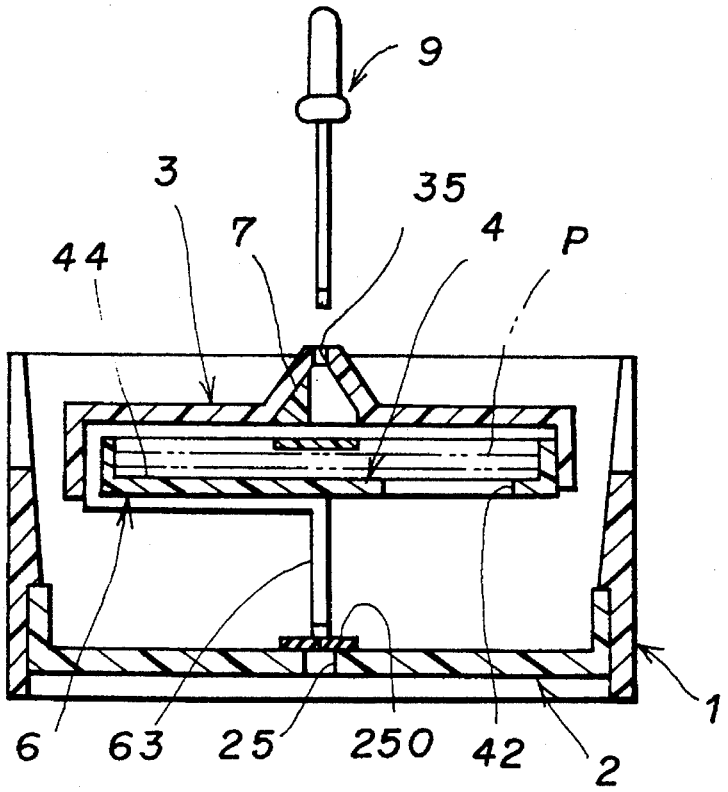
FIG. 23 is a schematic sectional view taken along the line XXIII—XXIII in FIG. 22.
Figure 24:
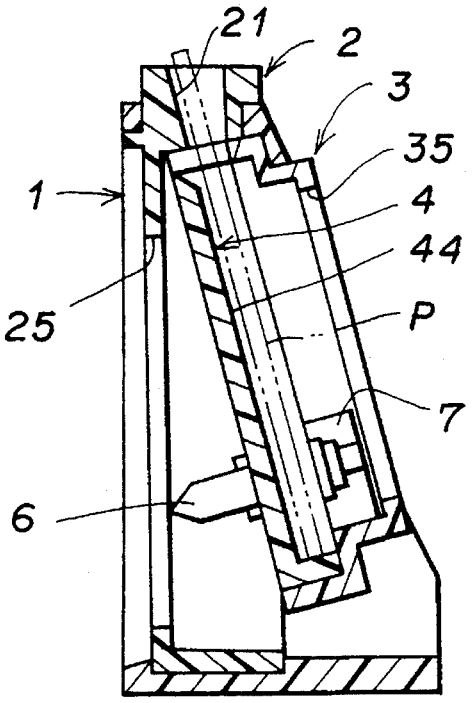
FIG. 24 is a schematic sectional view taken along the line XXIV—XXIV in FIG. 22.
Figure 26:
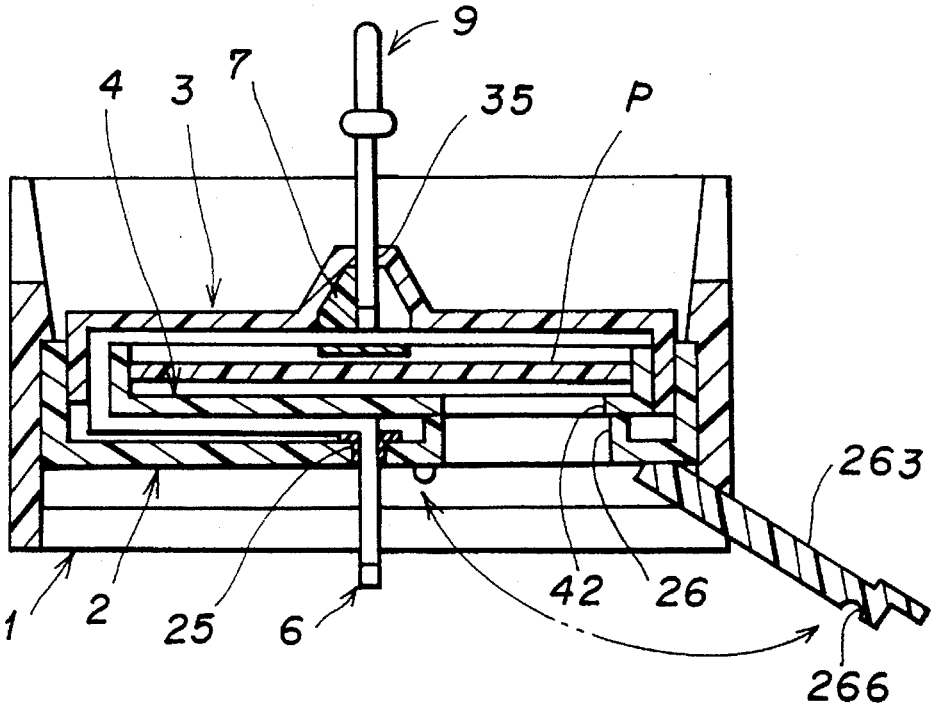
FIG. 26 is a schematic sectional view taken along the line XXVI—XXVI in FIG. 25.
Figure 27:
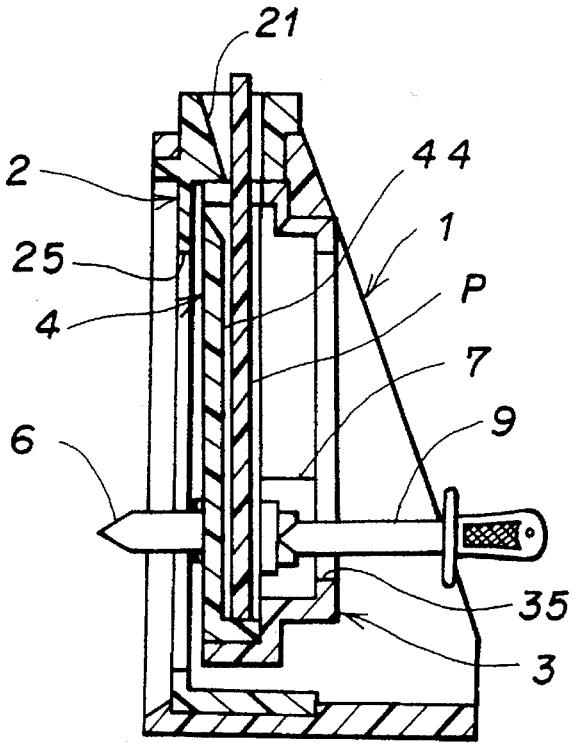
FIG. 27 is a schematic sectional view taken along the line XXVII—XXVII in FIG. 25.

Furthermore, this embodiment of the magical trick device according to the present invention has the windows 26 and 42 formed in the front member 2 and cover member 4, respectively. Also, the door 263 is provided on the front member 2. By opening the window 263 as shown in FIGS. 25 and 26 when the tip portion 63 of the dummy cutter 6 is projected out of the vertical slit 25 in the front member 2 as shown in FIG. 25, the card P actually received in the case assembly B is visible to the audience through the windows 26 and 42. At this time, the trick break-through and slashing of the card P with the cutter 9 will appear more realistic.

Besides, there is provided the rubber membrane 250 as extended along and over the vertical slit 25 in the front member 2 to cover the vertical slit 25, so that it is possible to prevent the inside of the case assembly B from being visible through the vertical slit 25, whereby the secret of the trick can be prevented from being revealed and so a further enjoyment be ensured.

What is claimed is:

1. A magical trick device, comprising:

a cutter for use to play a trick of card slashing; a frame having a front and rear openings;

a front member fixed to the frame to cover the front opening of the frame and provided with a transversal slit formed in the top thereof and through which a card can be inserted and also a first vertical slit formed in the front thereof;

a case assembly pivotably attached to the front member by means of a hinge mechanism, having a card receiving space communicating with the transversal slit in the front member and provided with a second vertical slit corresponding to the first vertical slit and in which the cutter can be inserted;

a resilient member interposed between the front member and case assembly to always force the case assembly away from the front member; and a dummy cutter consisting of a sliding portion slidable along the second vertical slit inside the case assembly, an elongated C-shaped portion extending from the sliding portion to outside the case assembly, and a tip portion extending nearly perpendicularly to the first or second vertical slit, having a substantially same shape as the cutter;

the tip portion of the dummy cutter beings projected out from the first vertical slit in the front member when the case assembly is pressed and pivoted toward the front member against the resilience of the resilient member.

2. A magical trick device according to claim 1, wherein the cutter is a fake sword and the tip portion of the dummy cutter is formed identical to that of the fake sword.

3. A magical trick device according to claim 1, wherein the front member is provided with a first window formed adjacently to the first vertical slit therein and through which the card inserted in the case assembly is visible from outside and an operable door of such a size that it can close the first window, the case assembly having a second window formed in a position corresponding to the first window.

4. A magical trick device according to claim 1, wherein there is provided on the rear side of the front member and over the first vertical slit an elastic membrane in which a cut is formed along the first vertical slit.

5. A magical trick device according to claim 1, wherein the front member has formed on the front thereof a holder to removably receive the cutter.

6. A magical trick device, comprising:

a fake sword for playing the trick of cutting of a card;

a frame having a front and rear openings;

a front member fixed to the frame to close the front opening of the frame, having a transversal slit formed in the top thereof and through which a card can be inserted, a first vertical slit formed in the front thereof, an elastic membrane provided on the rear side thereof and over the first vertical slit and in which a cut is formed along the first vertical slit, a first window formed adjacently to the first vertical slit and through which the inserted card is visible from outside, an operable door of such a size that it can close the first window and a holder provided on the front thereof to removably receive the fake sword;

a case assembly pivotably attached to the front member by means of a hinge mechanism, having a second window formed in a cover member thereof in a position corresponding to the first window in the front member, a second vertical slit formed in a rear member thereof in a position corresponding to the first vertical slit and a card receiving space defined between the cover and rear members and which communicates with the transversal slit in the front member;

a resilient member interposed between the front member and case assembly to always force the case assembly away from the front member; and a dummy fake sword consisting of a sliding portion slidable along the second vertical slit inside the case assembly, an elongated C-shaped portion extending from the sliding portion to outside the case assembly, and a tip portion extending nearly perpendicularly to the first or second vertical slit, having a substantially same shape as the tip of the fake sword and which is projected out from the first vertical slit in the front member when the case assembly is pressed and pivoted toward the front member against the resilience of the resilient member.

* * * * *